United States Patent [19]

Rofidal

[11] 4,007,995

[45] Feb. 15, 1977

[54] METHOD OF PROVIDING A SURFACE DRESSING FOR A ROADWAY

[75] Inventor: Serge Rofidal, Paris, France

[73] Assignee: Huiles Goudrons et Derives, Paris, France

[22] Filed: July 9, 1975

[21] Appl. No.: 594,435

[30] Foreign Application Priority Data

| | | |
|---|---|---|
| July 16, 1974 | France | 74.24732 |
| Apr. 10, 1975 | France | 75.11273 |

[52] U.S. Cl. ..... 404/77

[51] Int. Cl.[2] ..... E01C 7/06

[58] Field of Search ..... 404/79, 77

[56] References Cited

UNITED STATES PATENTS

| | | | |
|---|---|---|---|
| 1,462,851 | 7/1923 | Cooper | 404/77 |
| 3,025,773 | 3/1962 | McConnaughay | 404/79 |
| 3,410,185 | 11/1968 | Harrington | 404/77 |
| 3,807,886 | 4/1974 | Cutler | 404/77 |

OTHER PUBLICATIONS

"Highway Design and Construction", 2nd edition, by A. G. Bruce; International Textbook Company, Scranton, Penn., 1937, pp. 344–347.

*Primary Examiner*—Nile C. Byers
*Attorney, Agent, or Firm*—Lewis H. Eslinger

[57] ABSTRACT

The invention relates to a method of providing a surface dressing for a roadway and includes contacting an aggregate (granular material) and a binder in situ on the roadway and heating the layer thus formed to a temperature measured at about 1mm. below the surface of the layer of betweeen 100° C and 200° C. The method can be applied either to a new surface dressing or to a repair operation and in the latter instance where the surface has become polished as a result of loss of aggregate from the surface, the aggregate is merely distributed over the polished surface and the heat applied to the required temperature.

6 Claims, No Drawings

METHOD OF PROVIDING A SURFACE DRESSING FOR A ROADWAY

The invention relates to a method of providing superficial coverings or coatings of roadways hereinafter termed "surface dressing."

According to the present invention, there is provided a method of providing a surface dressing for a roadway comprising placing an aggregate and binder in physical contact and heating the composite layer thus formed to a temperature of the binder measured at about 1mm. below the surface of the said composite layer between 100° and 200° C.

The heating in accordance with the invention serves to ensure complete enrobing of the granular aggregate by the binder and is conducive to providing a composite layer which is very "solid" i.e. without voids, although it may sometimes be necessary to follow the basic steps with a compacting stage effected by conventional method.

The method according to the invention can be used for the production of new surface dressings and for the repair of old surface dressings.

Surface dressings, also known as "superficial coatings" and "wear coatings," are thin coverings which do not impart any reinforcing effect to roadways but which form rolling layers either on roadways already covered by a surface dressing on which it is necessary to effect maintenance, or on new roadways on which these dressings form the rolling layer.

The technique currently used for producing surface dressing consists in depositing on the surface to be covered a hot layer of hydrocarbon binder on which there is deposited, as rapidly as possible, a predetermined quantity of chippings or other aggregate. Thus during the same operation the deposit of the hydrocarbon binder, the adhering of this binder to the layer below and the enrobing (and adhering together) of the granular material by the binder are effected. Because of this multiple requirement, hydrocarbon binders have been proposed, such as liquid bitumens or flux-containing bitumens, emulsions of bitumen, tars or bituminous tars or bitumens containing synthetic resins, elastomers or various loaders.

Since, in accordance with the present invention, the various functions of the hydrocarbon binder are dissociated, it is possible and desirable to utilize a hydrocarbon binder having good adhesive properties and which is very viscous and not susceptible to deterioration by various solvents intended to render it more fluid (that is to say a nonfluxed binder). Furthermore, it is desirable to deposit the binder on the substrate at a relatively low temperature, (that is to say lower than the temperature at which it is necessary to work for the same type of tar according to techniques currently used) generally lying between about 80° and 140° C.

As a hydrocarbon binder having good adhesive qualities, preferably a pure bitumen is used (of which the penetration index may lie between 40 and 220). The adhesive properties of such a bitumen are improved by the inclusion either of a soft pitch produced by the distillation of tar oil or of steam cracking, or known adhesive agents such as polymers or resins. It will be understood that several products such as those cited above can be used simultaneously to improve the adhesive qualities of the bitumen. The preferred bituminous binder comprises :- from 70% to 85% by weight of pure bitumen, and from 15% to 30% by weight of tar oil pitch, this mixture optionally comprising various resins or polymers.

Known aggregates (granular materials) specified in Standards relating to surface dressings can be used, having for example a granulometric index defined by the ratio d/D (little *d* and capital D being the meshes of minimum and maximum sieves) of from 4–6.3 or 6.3–10 or 10–14.

The laying of surface dressings in accordance with the invention may be effected according to the following method which is given by way of example only.

A layer of hydrocarbon binder is poured on to the surface to be covered; this layer has a thickness comparable to that of conventional layers of hydrocarbon binders used for surface dressings, that is to say corresponding to a quantity of binder which lies between about 0.8 and 1.8kg per square meter. This layer of binder is deposited at relatively low temperatures, taking into account the specific properties of this binder, between about 80° and 140° C. Binders hitherto used require temperatures of the order of at least 160° C.

The aggregate is then poured so as to form a carpet of solid material on the binder, the quantity of aggregate used being of the same order as the quantity of aggregate employed in previously proposed surface dressings, less the normal excess which is, in the latter case, totally unusable. Compacting of the aggregate and of the bituminous binder is then effected, for example by rolling according to known procedures; in certain cases however, this compacting operation can be omitted.

Finally, the layer of aggregate and binder and of the upper surface of the substrate upon which the layer of aggregate and binder rest, are heated to a temperature lying between about 100° and 150° C. This heating can be effected by a known heating means such as a flow of hot gas (air for example) or by infra-red radiation. It is important to note that the heating must provide not only good adhesion between the aggregate and the hydrocarbon binder, but also good adhesion between the complex layer and the substrate on which it rests.

It is possible to provide several such surface dressings superposed on one another.

Certain roadways or portions of roadways produced conventionally and made of agglomerated granular material with a hydrocarbon binder become too smooth as a result the hydrocarbon binder rising and end up no longer having the superficial roughness desirable for safe passage of vehicles. This is the case for roadways having a depth of sand, measured in accordance with the L.C.P.C. method less than 0.04mm.

The technique currently used for reimparting roughness to such smooth and polished roadways consists in coating with a surface dressing often termed a "wear dressing." These wear dressings are provided by depositing on the roadway, a hot layer of a conventional carbon binder on to which is deposited a predetermined quantity of granular material in accordance with very exact characteristics, of dimensions, of hardness, of cleanliness, of shape and so on.

Further according to the present invention, there is provided a method of repairing a roadway which has become superficially slippery owing to an excess of hydrocarbon binder at the surface comprising spreading a layer of aggregate over the roadway to be treated, heating the layer of aggregate and the layer of hydrocarbon binder therebelow to a temperature, measured at a depth of 1mm within the said layer, lying between 100° and 200° C and then compacting the layer which has been heated.

The layer aggregate is preferably of granular materials having dimensions 6–10mm and 16–18mm used at a rate of from 6 to 12 liters per square meter.

The heating in accordance with the invention can be effected by any known means, for example by a flow of hot air or other gas or by infra-red radiation. This heating is effected until the temperature of the binder at a depth of 1mm. has preferably reached a temperature lying between 150° and 180° C. It is in practice essential to ensure that the thus heated binder maintains all the desirable properties, in particular a good adhesive properties with the aggregate and that it should not be thermally degraded.

Any necessary final compacting is effected according to known methods, for example by rolling. It will be carried out so that the aggregate is embedded up to two-thirds of its height in the heated superficial layer of the roadway.

Starting with a roadway of which the "depth of sand" (depth of chippings in the surface dressing) is less than 40mm. it is possible to provide a renewed roadway with a "mean depth of the sand" of 1.4mm. by employing the method in accordance with the invention.

In this specification, the measurement of the "mean depth of sand" (mean depth of chippings) of a roadway is effected, according to Standard, by dispensing a known volume (25ml) of sand (chippings) (having a granulometry index of 0.16 to 0.315mm.) on the roadway and then smoothing out the sand so as to form a circular patch as large as possible and then measuring the mean diameter of the patch obtained in order to deduce the depth of the sand, which depth constitutes the measurement sought.

It is important to note that, contrary to previous experience, the heating of the binder to the temperature of operation of the method (100° to 200° C) does not alter the important properties of that binder. These properties were tested by measurement of the total of insolubles and measurement of the adhesive quality achieved according to the following tests:

For measuring the total insolubles an aromatic solvent, toluene, was used.

For the adhesive properties, below water, of the binder and of the aggregate, the granules enrobed by the hydrocarbon binder were immersed and then the percentage of the surface still covered by the binder was evaluated after a predetermined immersion time.

These tests have shown that the adhesive qualities of the binder are not substantially modified by heating as effected by the method in accordance with the invention and that the binder is subject practically to no degradation as a result of this heating. The results given in the table hereinafter are obtained with the following binders:

Bitumen 80–100 Binder 200 prepared by using 80% by weight of a bitumen 60–70 and 20% by weight of a fluxing tar having a viscosity of 59 seconds at BRTA 30 ° $\phi$ = 4mm. Binder 300 prepared according to the same proportions as those of the binder 200 from the same bitumen 60–70 and with a fluxing tar having a viscosity of 18 seconds at BRTA 30° $\phi$ = 4mm. Binder 281 prepared by mixing of 80% by weight of bitumen 60–70 and 20% by weight of soft pitch 48–50 E.V.T.

TABLE

| | Binder for treatment | | Properties of binder without aggregate after heating | | Properties of binder with aggregate after heating | |
|---|---|---|---|---|---|---|
| Binder | Insolubles. Tuolene test | Adhesive Index | Insolubles | Adhesive Index | Insolubles | Adhesive Index |
| BITUMEN 80/100 | 0% | 75—75<br>50–0 | 0 | 75—75<br>50—50 | — | — |
| BINDER 200 | 0.22 | 100—100<br>90—90 | 0.46 | 100—100<br>100–90 | 0.40 | 100—100<br>90—90 |
| BINDER 300 | 0.20 | 100—100<br>100–90 | 0.58 | 100—100<br>100—100 | 0.40 | 100—100<br>100—100 |
| BINDER 281 | 0.30 | 100—(—)<br>90-(—) | 0.40 | — | 0.37 | 100—(—)<br>100—(1) |

The following examples illustrate the method in accordance with the invention.

EXAMPLE 1

Production of a surface dressing.

A binary mixture constituted by 80% by weight of a bitumen (penetration index 80–100) and by 20% by weight of an oil tar (penetration index 300) was utilized as a bituminous binder. This mixture was poured on to a roadway at a temperature of from 100° to 120° C at a rate of 1.3kg to the square meter. A layer of aggregate having dimensions 8-10mm. was then spread on the layer of hydrocarbon binder. The mixed layer was then compacted by rolling so as to force the aggregate into the binder.

Then, with the aid of a hot air blower, the compacted layer was heated until it reached a temperature of about 130° C. The roadway is then ready for the traffic after a final compacting by rolling and, if required, a brushing operation for removal of excess granular material from its surface.

The method according to this example of providing a surface dressing for a roadway has the following advantages:

The use of a non-fluxed hydrocarbon binder economizes in the quantity of combustible oil, obviates the boiling off of light constituents contained in a fluxed binder, avoids the emissions of fumes during the laying of the binders, and enables the use of the same binder for all weathers.

By facilitating the adhesion of the aggregate and the binder and of the complex layer to the substrate, the surface dressing is rendered particularly resistant to traffic.

The hydrocarbon binder deposited on the roadway is immediately read for service. Furthermore, it will not suffer any subsequent change.

It is possible to construct these surface dressings in all weathers and at all seasons and whatever the state of the ground to be covered. In practice, if the surface to be covered is damp, an advantage will arise because of the provision of the heating means which can also be used to dry and possibly to pre-heat the surface to be coated. This advantage gives rise to additional interest in equipment intended to lay surface dressings in accordance with the invention.

The dressing provided is immediately usuable without risk of deterioration and without the risk of aggregate being thrown up by vehicles. In general, a simple brushing of the dressing is sufficient after it has been laid.

The application of the dressing can be avoided during months of intense long-distance traffic, that is to say July and August, thus facilitating traffic flow, since the work is possible during the rest of the year, contrary to known surface dressings for which good weather and heat are necessary, such as are experienced in July and August.

EXAMPLE 2

Repair of Slippery Roadway

On a roadway with a dangerous reputation because it is too smooth or polished, particularly during rainy weather, and having a depth of sand (chippings) of 0.4mm. a layer of aggregate was deposited at a rate of 6 to 8 liters per square meter, on the old surface. The aggregate had dimensions in the range 10 to 14mm. Subsequently, with the aid of a hot air blower, this layer of small gravel and the roadway were heated in order to produce a temperature of about 160° C at 1 millimeter depth.

Compacting with the aid of an 8 metric tonnes smooth roller followed in order to imbed the aggregate up to a third of its height.

The roadway then had a mean depth of sand of 1.4mm. and could be immediately subjected to traffic.

The method described in this example has the following important advantages:

The omission of hydrocarbon binder constitutes an important economy because of both the provision and laying of the binder are avoided and also enables the elimination of boiling off which is in general the consequence of accidental excess provision of binder.

It permits the roadway to be put in use again immediately.

It can be laid at all seasons even on a damp roadway and in particular in winter when the laying of other surface dressings is not possible.

We claim:

1. The method of providing a surface coating on roadways constituted by a binder and aggregate comprising, the steps of, placing a layer of aggregates in physical contact with a solid layer of binder formed of 70% to 85% by weight of bitumen and 15% to 30% by weight of pitch tar and thereafter heating the layer thus obtained until the temperature of the binder, measured at a depth of 1 mm below the surface of the binder, reaches a temperature of between 100° C. and 200° C.

2. The method as defined in claim 1 wherein said placing step comprises the steps of first depositing said layer of said binder on the roadway to be covered and thereafter depositing said aggregate on the binder layer.

3. A method of providing a surface dressing for a roadway comprising, the steps of, depositing on a roadway surface to be covered a viscous, solvent-free hydrocarbon binder layer having adhesive qualities and being formed of 70% to 85% by weight of bitumen and 15% to 30% by weight of pitch tar;

said depositing step including the steps of spreading the binder on said surface at a rate of between 0.08 and 1.02 kg. per square meter, thereafter depositing aggregates on said binder and then heating the resulting layer of binder and aggregate to a temperature lying between 100° C and 200° C to adhere the elements of the combined layer together and to adhere the combined layer to the surface to be covered.

4. A method according to claim 3 wherein the depositing of the hydro-carbon binder is effected at a temperature lying between 80° and 140° C.

5. The method of repairing a roadway which has a hydrocarbon binder layer on its surface formed of 70% to 85% by weight of bitumen and 15% to 30% by weight of pitch tar comprising the steps of spreading a layer of aggregate over said layer on the surface of the roadway, heating the layer of aggregate and the layer of hydrocarbon binder therebelow to a temperature, measured at a depth of 1 mm within the layer, of between 100° C and 200° C and thereafter compacting said layers of binder and aggregate.

6. A method according to claim 5, wherein the said temperature lies between 150° and 180° C.

* * * * *